US009165711B2

(12) United States Patent
Lim et al.

(10) Patent No.: US 9,165,711 B2
(45) Date of Patent: Oct. 20, 2015

(54) METHOD OF MANUFACTURING A MULTILAYERED CHIP POWER INDUCTOR

(71) Applicant: CHANG SUNG CORPORATION, Chungcheongbuk-do (KR)

(72) Inventors: Sung Tae Lim, Pyeongtaek (KR); Tae Kyung Lee, Incheon (KR); Doo In Kang, Incheon (KR); Chung Ryul Kim, Incheon (KR)

(73) Assignee: Chang Sung Corporation, Chungcheongbuk-Do (KR)

( * ) Notice: Subject to any disclaimer, the term of this patent is extended or adjusted under 35 U.S.C. 154(b) by 167 days.

(21) Appl. No.: 13/762,672

(22) Filed: Feb. 8, 2013

(65) Prior Publication Data

US 2014/0047704 A1 Feb. 20, 2014

Related U.S. Application Data

(62) Division of application No. 13/318,130, filed on Jan. 13, 2012, now abandoned.

(30) Foreign Application Priority Data

May 1, 2009 (KR) ..... 10-2009-0038676

(51) Int. Cl.
*H01F 7/06* (2006.01)
*H01F 41/02* (2006.01)
(Continued)

(52) U.S. Cl.
CPC ..... *H01F 41/02* (2013.01); *H01F 17/0033* (2013.01); *H01F 41/046* (2013.01); *Y10T 29/49078* (2015.01)

(58) Field of Classification Search
CPC ... H01F 2003/005; H01F 5/02; H01F 17/045; H01F 27/24; H01F 27/2895; H01F 27/29; H01F 41/0206; H01F 41/065; H01F 41/046; H01F 41/16; H01F 41/32; Y10T 29/4902; Y10T 29/49071; Y10T 29/49073; Y10T 29/49075; Y10T 29/49078
USPC ..... 29/602.1, 604–607; 336/110, 178, 184, 336/214, 215, 234; 363/17, 48, 58
See application file for complete search history.

(56) References Cited

U.S. PATENT DOCUMENTS 5,552,756 A 9/1996 Ushiro
6,541,968 B1 4/2003 Tokuda
(Continued)

FOREIGN PATENT DOCUMENTS

CN 101310346 10/2006
EP 1011115 6/2000
(Continued)

*Primary Examiner* — Paul D Kim
(74) *Attorney, Agent, or Firm* — Arent Fox LLP

(57) ABSTRACT

Disclosed is a method of manufacturing a multilayered chip power inductor by forming a laminate body having upper and lower sides by laminating magnetic sheets, forming an inner hollow by punching out a middle part of said laminate body, inserting a magnetic core into the inner hollow, where an electrical conductive coil is wound into said inner hollow, laminating a first copper clad magnetic sheet onto the upper and lower sides of said laminate body having the magnetic core in the inner hollow as a land layer having upper and lower sides, forming a land by etching said land layer, forming a hole by drilling the land, plating the hole formed in the land, laminating a second copper clad magnetic sheet as a terminal layer onto upper and lower sides of the land layer having the land, forming a terminal by etching the terminal layer, forming a hole by drilling the terminal, and plating the hole.

1 Claim, 3 Drawing Sheets

(51) Int. Cl.
*H01F 17/00* (2006.01)
*H01F 41/04* (2006.01)

(56) References Cited

U.S. PATENT DOCUMENTS

| | | | | |
|---|---|---|---|---|
| 6,588,097 | B2 * | 7/2003 | Nishide et al. | 29/832 |
| 6,956,455 | B2 | 10/2005 | Tokuda | |
| 2002/0105788 | A1 | 8/2002 | Tokuda | |
| 2002/0121957 | A1 | 9/2002 | Takashima | |
| 2009/0002117 | A1 | 1/2009 | Kawarai | |
| 2009/0051474 | A1 | 2/2009 | Lee | |
| 2010/0001823 | A1 | 1/2010 | Kawarai | |
| 2010/0259351 | A1 | 10/2010 | Bogert et al. | |

FOREIGN PATENT DOCUMENTS

| | | | | |
|---|---|---|---|---|
| JP | 49004116 | | 4/1972 | |
| JP | 57178414 | | 5/1981 | |
| JP | 62104112 | | 5/1987 | |
| JP | 2310905 | | 12/1990 | |
| JP | 04106910 | A * | 4/1992 | H01F 17/04 |
| JP | 5347232 | | 12/1993 | |
| JP | 6196333 | | 7/1994 | |
| JP | 6215949 | | 8/1994 | |
| JP | 7-32908 | | 6/1995 | |
| JP | 09306715 | | 11/1997 | |
| JP | 10106839 | | 4/1998 | |
| JP | 11195533 | | 7/1999 | |
| JP | 2001176728 | | 6/2001 | |
| JP | 2004319875 | | 11/2004 | |
| JP | 2005142389 | | 6/2005 | |
| KR | 20000040048 | | 7/2000 | |
| KR | 20090051106 | | 5/2009 | |
| TW | 544698 | | 11/2001 | |
| WO | WO2005043565 | | 5/2005 | |

* cited by examiner

METHOD OF MANUFACTURING A MULTILAYERED CHIP POWER INDUCTOR

CROSS-REFERENCE TO RELATED APPLICATION

This Application is a divisional of U.S. patent application Ser. No. 13/318,130, filed Jan. 13, 2012 now abandoned, entitled "STACKED INDUCTOR USING MAGNETIC SHEETS, AND METHOD FOR MANUFACTURING SAME," the contents of which are hereby incorporated by reference herein in their entirety.

DETAILED DESCRIPTION OF THE INVENTION

1. Technical Field

The present invention relates to a multilayered chip power inductor with high direct current superposition characteristics and high-frequency characteristics, particularly to a multilayered chip power inductor using magnetic sheets filled up with soft magnetic metal powder and a magnetic core as magnetic substances.

2. Background Art

Due to the diversification of portable devices, types of the operating power supplies for the power circuit of a portable device have been diversified. For portable devices are used such power supplies as an LCD drive, power amplifier module, base band IC, etc. Each of the power supplies requires a different voltage for operation, and requires a power circuit for converting a voltage supplied from a power source to an operating voltage of its circuit. Due to the decrease in the size of semiconductors, the voltage of their power circuits has decreased, and thus even a small change in voltage may lead to malfunction of the devices. In order to prevent such problem, in general, a distributed power (POL) scheme is used, where a power supply is arranged near each LSI to reduce voltage fluctuation by using the line inductance between a power source and the LSI or wiring resistance.

As a result, portable devices require power sources for controlling each LSI individually, and many power circuits therein.

Power circuits of a portable device are categorized into two major groups: linear regulators and switching regulators. Recent trends have been towards reducing power consumption to lengthen battery life, and accordingly, switching regulators (generally, called DC-DC converters) suffering less power loss in voltage conversion have been more commonly used.

Meanwhile, in terms of miniaturization, a DC-DC converter needs attached parts such as an inductor, condenser, etc., which increases the area of a power circuit; thus, in order to miniaturize the device, it is necessary to miniaturize those parts first. These parts can be miniaturized by decreasing the required constants of inductors or condensers by increasing the switching frequency of a DC-DC converter.

Recently, due to advance in the performance of IC according to the advance of semiconductor manufacture technology, higher switching frequencies have been further progressed. Under this trend, a wound-rotor inductor, produced by coiling a wire around an oxide magnetic material, has been typically used as a power inductor for the circuit of a DC-DC converter. However, such inductors have an intrinsic limitation in miniaturization.

Accordingly, with the advance in ceramic materials technolgy, a spotlight has been on a multilayered power inductor.

Ferrite-based metal oxides, commonly used as magnetic material of a multilayered power inductor, have high permeability and electrical resistance while having low saturation flux density. Thus, ferrite-based metal oxides achieve low inductance due to magnetic saturation, and have poor direct current superposition characteristics.

In addition, in conventional multilayered power inductors, in order to ensure direct current superposition characteristics, a nonmagnetic material layer needs to be inserted between layers as a gap.

In additon, in the case of an inductor using ferrite, a circuit is placed on a ferrite substrate, and then has to be sintered; in this case, however, the inductor may be distorted during the sintering process, which poses an obstacle in ensuring a certain level of inductance and direct current superposition characteristics. Thus, such inductors cannot be designed to be wide. In particular, under the recent circumstances where the size of inductors has been reduced and products with a width of 1 mm or less are manufactured, the width of inductors is much more limited; thus, an inductor using ferrite cannot achieve varous types of inductance, and current superposition characteristcs.

In addition, even in the case of a multilayered inductor using a magnetic sheet filled up with magnetic materials, excellent inductor characteristics could not be achieved simply by including a magnetic sheet in the electrical conductive circuit of the inductor.

CONTENTS OF THE INVENTION

Problems to be Solved

The present invention was conceived to solve said problems. An objective of the present invention is to provide a power inductor without leakage of magnetic flux and limitation in current due to magnetic saturation.

Another object of the present invention is to provide a high capacity, ultrathin power inductor which can be used without limitation in width.

Another object of the present invention is to provide a multilayered chip power inductor achieving high inductance and high direct current superposition characteristics by including a magnetic core in the inductor.

Yet another object of the present invention is to provide a multilayered chip power inductor ensuring low direct current resistance by using a copper wire for the electrical conductive circuit of the inductor.

Technical Means for Solving the Problems

In order to achieve the above objectives, the present invention provides a multilayered chip power inductor using a magnetic sheet, characterized in that a plurality of magnetic sheets are laminated, wherein an electrical conductive circuit is formed on the surfaces of said sheets; that a terminal is formed at an outermost part; that said electrical conductive circuit and said terminal are electrically connected through via holes, and form a circuit in the form of a coil; and that an inner hollow is formed in said circuit in the form of a coil and a magnetic core is inserted into said inner hollow.

In addition, the present invention provides a multilayered chip power inductor using the magnetic sheet, characterized in that a plurality of magnetic sheets are laminated, that a terminal is formed at an outermost part, that an inner hollow is formed in said laminated magnetic sheets and a magnetic core, where an electrically conductive coil is wound, is inserted into said inner hollow, and that said electrical conductive coil and said terminal are electrically connected through via holes.

In addition, the present invention provides a multilayered chip power inductor using the magnetic sheet, characterized in that inner layers of said magnetic sheets are isotropic magnetic sheets filled up with isotropic powder, and that outer layers of said magnetic sheets are magnetic sheets filled up with anisotropic metal powder.

In addition, the present invention provides a multilayered chip power inductor using the magnetic sheet, characterized in that said magnetic core is any one of Mo-permalloy, permalloy, Fe—Si—Al alloy, Fe—Si alloy, silicon steel plate, ferrite, and amorphous metal.

In addition, the present invention provides a method of manufacturing a multilayered chip power inductor using magnetic sheets, the method comprising the steps of: forming an electrical conductive circuit by etching the surface of a Cu clad magnetic sheet, forming a via hole by drilling, and plating the inner side of said via hole to form a circuit layer; laminating said circuit layer, forming a laminate body by laminating a Cu clad magnetic sheet onto the upper and lower sides of said circuit layer as a land layer, forming a land by etching said land layer, forming a via hole by drilling, and plating the via hole; forming an inner hollow by punching the middle part of said laminate body and then inserting a magnetic core into said inner hollow; and forming a terminal by laminating, and etching, a separate Cu clad magnetic sheet, as a terminal layer, at the upper and lower sides of the laminate body where said magnetic core is inserted, forming a via hole by drilling, and plating the via hole.

In addition, the present invention provides a method of manufacturing a multilayered chip power inductor using magnetic sheets, characterized in that an isotropic magnetic sheet filled up with isotropic powder is applied to said circuit layer, and that magnetic sheets filled up with anisotropic metal powder are applied to said land layer and said terminal layer.

In addition, the present invention provides a method of manufacturing a multilayered chip power inductor using magnetic sheets, comprising the steps of: forming a laminate body by laminating magnetic sheets, forming an inner hollow by punching the middle part of said laminate body, and then inserting a magnetic core, where an electrical conductive coil is wound, into said inner hollow; laminating a Cu clad magnetic sheet onto the upper and lower sides of said laminate body as land layer, forming a land by etching said land layer, forming a via hole by drilling, and plating the via hole; forming a terminal by laminating, and etching, a separate Cu clad magnetic sheet, as a terminal layer, at the upper and lower sides of the land layer, forming a via hole by drilling, and plating the via hole.

Effects of the Invention

Unlike conventional power inductors, the present invention can obtain high frequency and high-capacity saturation current. In addition, by using soft magnetic metal powder sheets, the present invention can provide a thin inductor which does not have limitations in width in an economical way, and thus makes it possible to provide a slim laptop computer, cellular phone, display device, etc.

BEST MODES FOR CARRYING OUT THE INVENTION

Hereinafter, the present invention will be described with reference to the drawings.

FIG. 1 is an exterior view of an embodiment of the present invention. FIG. 1 illustrates an inductor (10) formed by lamination of magnetic sheets, where a terminal (11) is formed at an outermost part thereof. The magnetic sheets are formed by filling up a binder with soft magnetic metal alloy powders.

As said soft magnetic metal alloy powder, anisotropic or isotropic powder in the form of a flat flake is employed. In addition, as material of the alloy powder, Mo-permalloy, permalloy, Sandust (Fe—Si—Al alloy), Fe—Si alloy, amorphous metal, nano crystal grain, etc. may be used.

As said binder, EPDM, acrylic resin, polyurethane, silicon rubber, etc., which are applied as organic high molecule matrix material, may be used.

A terminal is made up of a conductive metal such as Cu. Said terminal is formed by a method according to which a Cu-clad magnetic sheet is selectively etched for only a Cu portion to remain, and nickel and tin may be plated around the copper terminal.

Portions other than the terminal are coated with epoxy resin insulation.

FIG. 2 is a sectional view (A-A of FIG. 1) of the multilayered chip power inductor according to one embodiment of the present invention. FIG. 2 illustrates a multilayered chip power inductor (10), wherein a circuit layer (12), where an electrical conductive circuit is formed on a surface of a magnetic sheet, is laminated, and a land layer (14), where a land is formed, and a terminal layer (16), where a terminal is formed, are laminated one after another onto the upper and lower sides of said circuit layer (12).

On the magnetic sheet of said circuit layer (12), an electrical conductive circuit may be formed on one surface or may be formed on both surfaces.

In case the electrical conductive circuit is formed on both surfaces, a magnetic sheet, where an electrical conductive circuit is not formed, is inserted between the magnetic sheets and functions as an insulation layer.

The conductive circuit, the land, and the terminal, of each circuit layer (12) are electrically connected through via holes to form a whole circuit in the form of a coil, and an inner hollow is formed in said circuit, and a magnetic core (18) is inserted into said inner hollow. In other words, it has a structure where a circuit in the form of a coil is wound around a magnetic core (18). For magnetic core (18), Mo-permalloy, permalloy, Fe—Si—Al alloy, Fe—Si alloy, silicon steel plate, ferrite, and amorphous metal can be used.

FIG. 3 is a sectional view of a multilayered chip power inductor according to another embodiment of the present invention. FIG. 3 illustrates a multilayered chip power inductor (20) wherein as in FIG. 2, a circuit layer (22), where an electrical conductive circuit is formed on a surface of a magnetic sheet, a land layer (24) and a terminal layer (26) are formed, and a magnetic core (28) is inserted inside.

Here, an isotropic magnetic sheet, where the form of the soft magnetic powder filling up the magnetic sheet is spherical and its length and width are similar to each other, with an isotropic property with respect to a magnetic path, is applied to the circuit layer (22), and an anisotropic magnetic sheet, where soft magnetic powder is in a flake form and parallel with respect to the magnetic path, is applied to the land layer (24) and the terminal layer (26).

In case of a plurality of circuit layers (22), said circuit layers may be classified into isotropic magnetic sheets in the inner circuit layers and anisotropic magnetic sheets in the upper and lower layers.

In FIG. 3, the direction of a magnetic path occurring in the multilayered chip power inductor is related to the arrangement direction of soft magnetic powder. In other words, an anisotropic magnetic sheet is applied to the upper and lower sides of the inductor, and an isotropic magnetic sheet is applied to the middle part of said inductor, thereby forming a magnetic path (29) in the arrow direction in said Figure; here, when the length direction of anisotropic alloy powder of said anisotropic magnetic sheet is parallel to the magnetic path, inductance increases.

In some cases, an anisotropic particle is arranged vertically at the left and right sides of the circuit layers (22), thereby making it parallel to the magnetic path (29).

FIG. 4 is a sectional view of another embodiment of the present invention. This embodiment relates to a multilayered chip power inductor (70) where a conductive coil of a Cu wire is wound around a magnetic core and is inserted into a magnetic sheet. A laminate body (72) is formed by laminating a magnetic sheet where an electrical conductive circuit is not formed; an inner hollow is formed in said laminate body (72); a magnetic core (78), where a conductive coil is wound, is inserted in the inner hollow; and a land layer (74) and a terminal layer (76) where a terminal (71) is formed, are laminated onto the upper and lower sides of the magnetic sheets.

Hereinafter, a process for manufacturing an inductor according to the present invention will be described.

FIG. 5 is a schematic view of one embodiment of a method of manufacturing a multilayered chip power inductor according to the present invention.

A surface of a Cu clad magnetic sheet (32) is etched and an electrical conductive circuit (34) is formed to prepare a plurality of circuit layers (30). Said electrical conductive circuit (34) is drilled to form a via hole (36), and the inner side of said via hole is plated with a conductive material. A plurality of circuit layers (30) are laminated, and a separate Cu clad magnetic sheet (42) is laminated onto the upper and lower sides as land layer (40), and etched to form a land (44); the land (44) is drilled to form a via hole (46); and then the inside of said via hole (46) is plated with a conductive material. Here, in case where an electrical conductive circuit (34) is formed on both sides of the magnetic sheet (32), a magnetic sheet (35) where an electrical conductive circuit is not formed is interposed. This magnetic sheet (35) functions as an insulation layer so that electrical conductive circuits (34) do not contact each other.

A circuit layer (30) and a land layer (40) are laminated to form a laminate body as shown above, and the middle part of said laminate body is punched to form an inner hollow, and then a magnetic core (50) is inserted therein.

After said magnetic core (50) is inserted, a separate Cu clad magnetic sheet is laminated, as a terminal layer (60), at the upper and lower sides, etched to form a terminal (64), and is drilled form a via hole, and the inner side of said via hole is plated. Each laminated electrical conductive circuit is connected through said plated via hole to form one circuit in the form of a coil as a whole. Lastly, surface portions other than said terminal may be plated with insulation such as epoxy.

As yet another embodiment, a multilayered chip power inductor illustrated in FIG. 4 where a magnetic core wound with a conductive coil is inserted may be manufactured.

In the process described above, instead of a Cu clad magnetic sheet (32), a typical magnetic sheet that is not clad with Cu is applied and laminated to form a laminate body (72), and then is punched to form an inner hollow, and a magnetic core (78) where a conductive coil is wound is inserted into the inner hollow.

A separate Cu clad magnetic sheet is laminated onto the upper and lower sides as land layer (74), and etched to form a land, which is drilled to form a via hole, and then the inner side of said via hole is plated with a conductive material.

Again, a separate Cu clad magnetic sheet is laminated as a terminal layer (76) at the upper and lower sides, and etched to form a terminal (71), and then drilled to form a via hole, and the inner side of said via hole is plated.

EXAMPLES

Working Example 1

Three circuit layers were manufactured by etching top and bottom surfaces of a Cu-clad 210×300×0.1 mm magnetic sheet prepared by mixing Fe—Si magnetic powder and EPDM, for 3 minutes with an iron chloride solution at a temperature of 50° C. and forming an electrical conductive circuit.

A via hole was formed by punching a hole in an electrical circuit by using a drill, with an external diameter of 0.2 mm, of a precise drilling machine, and the inner side of the via hole was plated with Cu.

Three circuit layers were laminated, a separate Cu clad magnetic sheet is laminated as a land layer onto the upper and lower sides of said circuit layers, and etched to form a land, which is drilled to form a via hole, and the inner side of said via hole was plated with an electrical conductive material.

The circuit layer and the land layer were laminated, and then an inner hollow with the width of 1 mmΦ was formed by punching the inner side, and then a permalloy magnetic core was inserted therein.

After the magnetic core was inserted, again, a separate Cu clad magnetic sheet is laminated as terminal layer onto the upper and lower sides, and etched to form a terminal, and then drilled to form a via hole, and the inner side of said via hole is plated. Last, surface portions other than said terminal were plated with epoxy.

Working Example 2

Three 210×300×0.1 mm magnetic sheets prepared by mixing Fe—Si magnetic powder and EPDM were laminated and then the inner side of said magnetic sheets was punched.

A permalloy magnetic core where a Cu wire of 0.15 mmΦ was wound was inserted into said punched hole of 1 mmΦ. A separate Cu clad magnetic sheet is laminated as a land layer onto the upper and lower sides, and etched to form a land, which is drilled to form a via hole, and the inner side of said via hole was plated with an electrical conductive material.

Again, a separate Cu clad magnetic sheet is laminated as terminal layer onto the upper and lower sides, and etched to form a terminal, and then drilled to form a via hole, and the inner side of said via hole is plated. Last, surface portions other than said terminal were plated with epoxy.

Comparative Example 1

Three circuit layers were manufactured by etching top and bottom surfaces of a Cu-clad 210×300×0.1 mm magnetic sheet prepared by mixing Fe—Si magnetic powder and EPDM, for 3 minutes with an iron chloride solution at a temperature of 50° C., and forming an electrical conductive circuit.

A via hole was formed by punching a hole in an electrical circuit by using a drill, with an external diameter of 0.2 mm, of a precise drilling machine, and the inner side of the via hole was plated with Cu.

Three circuit layers were laminated, a separate Cu clad magnetic sheet is laminated as a land layer onto the upper and lower sides of said circuit layers, and etched to form a land, which is drilled to form a via hole, and the inner side of said via hole was plated with an electrical conductive material.

Again, a separate Cu clad magnetic sheet is laminated as terminal layer onto the upper and lower sides, and etched to form a terminal, and then drilled to form a via hole, and the inner side of said via hole is plated. Last, surface portions other than said terminal were plated with epoxy.

The results of the measuring inductor characteristics of the working examples and the comparative example are shown in FIG. 6.

The graph shows a variation of the inductor according to frequencies. It can be understood that inductance according to frequencies of the working example 1 and working invention 2 is very high compared to the comparative example 1.

The embodiments of the present invention described above are only for examples, but the present invention is not limited to this, and various modifications and changes are possible.

Figure 1:
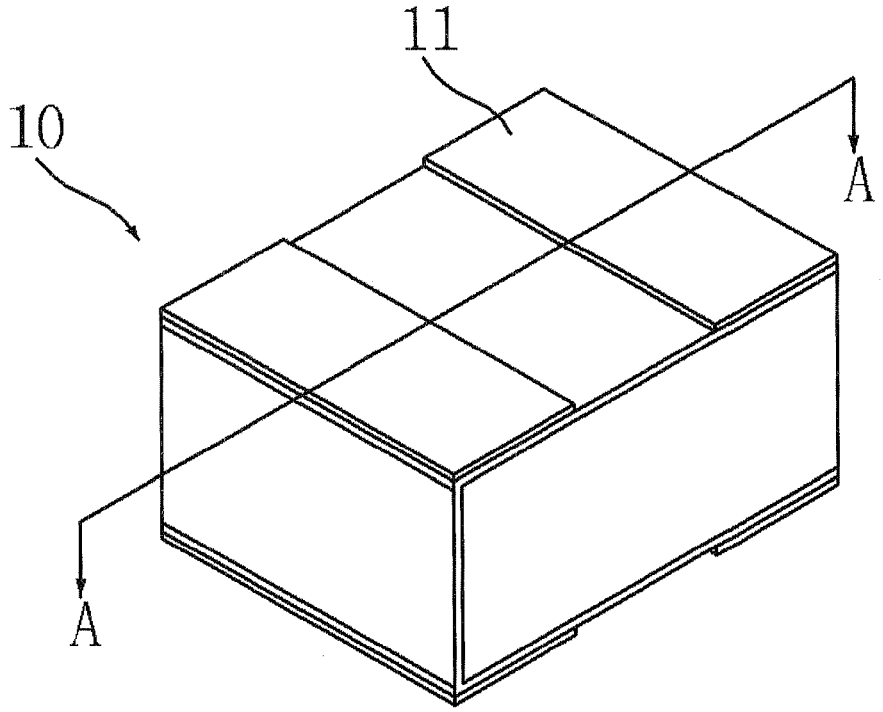
FIG. 1 is a perspective view of a multilayered power inductor according to an embodiment of the present invention.
Figure 2:
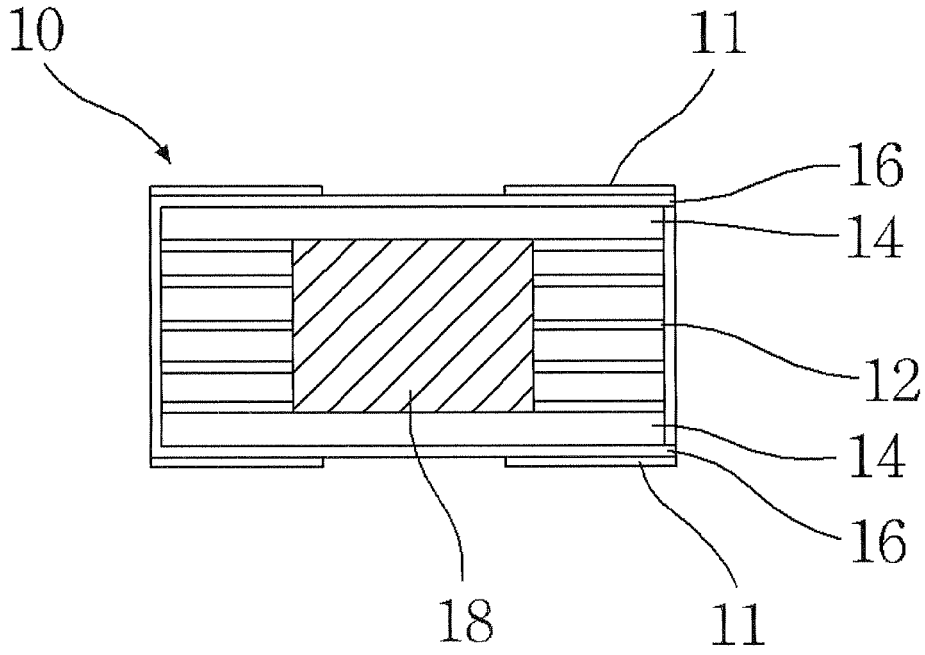
FIG. 2 is a sectional view of a multilayered power inductor according to one embodiment of the present invention.
Figure 3:
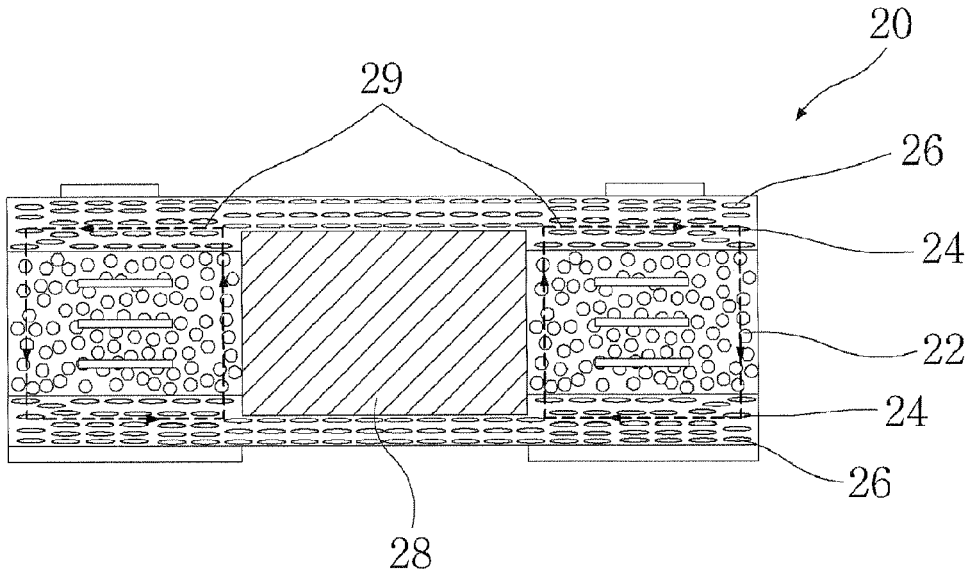
FIG. 3 is a sectional view of a multilayered power inductor according to another embodiment of the present invention.
Figure 4:
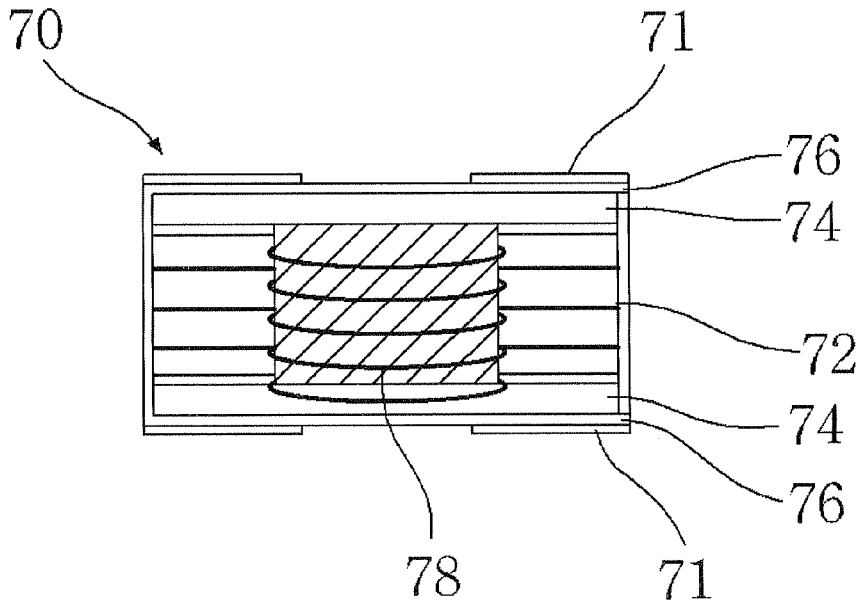
FIG. 4 is a sectional view of a multilayered power inductor according to another embodiment of the present invention.
Figure 5:
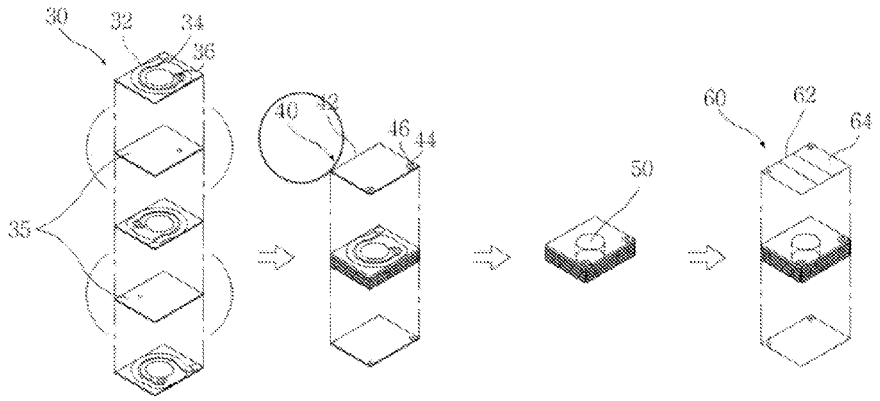
FIG. 5 is a flow diagram explaining a method of manufacturing a multilayered power inductor according to the present invention.
Figure 6:
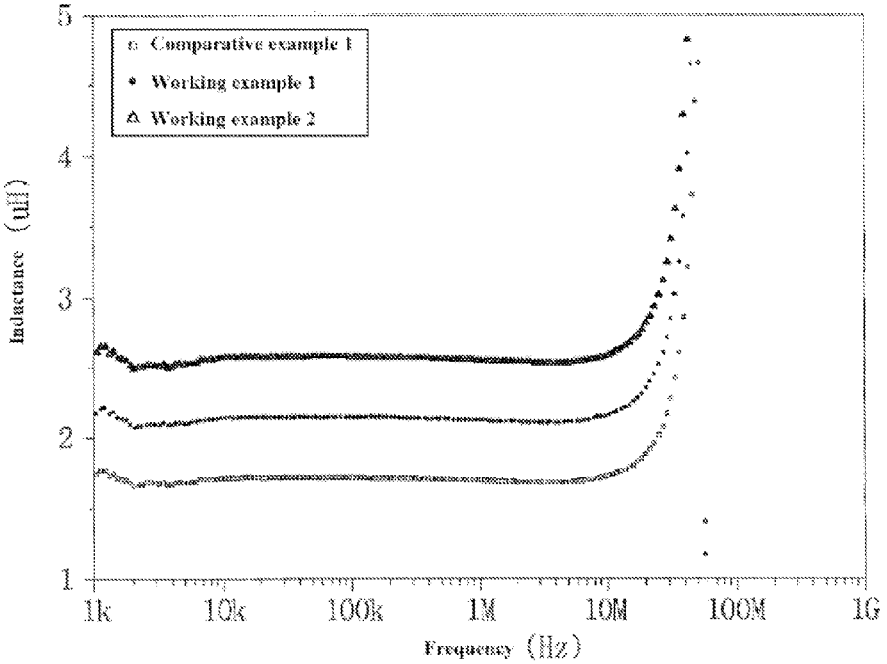
FIG. 6 is a graph showing characteristics of an inductor according to the present invention.

The invention claimed is:

1. A method of manufacturing a multilayered chip power inductor using a magnetic sheet comprising the steps of:

forming a laminate body having upper and lower sides by laminating magnetic sheets;

forming an inner hollow by punching out a middle part of said laminate body;

subsequently inserting a magnetic core into the inner hollow, where an electrical conductive coil is wound into said inner hollow;

laminating a first copper clad magnetic sheet onto the upper and lower sides of said laminate body having the magnetic core in the inner hollow as a land layer having upper and lower sides;

forming a land by etching said land layer;

forming a hole by drilling the land;

plating the hole formed in the land;

laminating a second copper clad magnetic sheet as a terminal layer onto upper and lower sides of the land layer having the land;

forming a terminal by etching the terminal layer;

forming a hole by drilling the terminal; and plating the hole formed in the terminal, wherein the hole formed in the land, the hole formed in the terminal and the electrical conductive coil are electrically connected.

* * * * *

UNITED STATES PATENT AND TRADEMARK OFFICE

CERTIFICATE OF CORRECTION

PATENT NO. : 9,165,711 B2
APPLICATION NO. : 13/762672
DATED : October 20, 2015
INVENTOR(S) : Sung Tae Lim et al.

It is certified that error appears in the above-identified patent and that said Letters Patent is hereby corrected as shown below:

On the title page

Item (22) reads:
(22) Filed: February 8, 2013

Item (22) should read:
(22) PCT Filed: April 30, 2010

Item (86) and (87) should read:
(86) PCT No.: PCT/KR10/02751
§ 371(c)(1),
(2),(4) Date: February 8, 2013

(87) PCT Pub. No.: WO2010/126332
PCT Pub Date: Nov. 4, 2010

Signed and Sealed this
First Day of March, 2016

Michelle K. Lee

Michelle K. Lee
*Director of the United States Patent and Trademark Office*